US010774406B2

(12) United States Patent
Umemori et al.

(10) Patent No.: US 10,774,406 B2
(45) Date of Patent: Sep. 15, 2020

(54) STEEL FOR MOLD AND MOLD

(71) Applicant: DAIDO STEEL CO., LTD., Nagoya-shi (JP)

(72) Inventors: Naoki Umemori, Nagoya (JP); Masamichi Kawano, Nagoya (JP); Takayuki Shimizu, Nagoya (JP)

(73) Assignee: DAIDO STEEL CO., LTD., Nagoya-Shi, Aichi (JP)

( * ) Notice: Subject to any disclaimer, the term of this patent is extended or adjusted under 35 U.S.C. 154(b) by 659 days.

(21) Appl. No.: 15/221,449

(22) Filed: Jul. 27, 2016

(65) Prior Publication Data

US 2017/0058385 A1 Mar. 2, 2017

(30) Foreign Application Priority Data

Aug. 28, 2015 (JP) ..... 2015-168946

(51) Int. Cl.

| | |
|---|---|
| ***C22C 38/60*** | (2006.01) |
| ***C22C 38/46*** | (2006.01) |
| ***C22C 38/44*** | (2006.01) |
| ***C22C 38/38*** | (2006.01) |
| ***C22C 38/30*** | (2006.01) |
| ***C22C 38/28*** | (2006.01) |
| ***C22C 38/26*** | (2006.01) |
| ***C22C 38/24*** | (2006.01) |
| ***C22C 38/22*** | (2006.01) |
| ***C22C 38/20*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 1/18*** | (2006.01) |
| ***C21D 8/00*** | (2006.01) |
| ***C22C 38/14*** | (2006.01) |
| ***C22C 38/58*** | (2006.01) |
| ***C22C 38/08*** | (2006.01) |
| ***C22C 38/18*** | (2006.01) |
| ***C22C 38/10*** | (2006.01) |
| ***C22C 38/42*** | (2006.01) |
| ***C22C 38/40*** | (2006.01) |
| ***C22C 38/12*** | (2006.01) |
| ***C21D 1/673*** | (2006.01) |

(52) U.S. Cl.

CPC ..... *C22C 38/60* (2013.01); *C21D 1/18* (2013.01); *C21D 1/673* (2013.01); *C21D 8/005* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/38* (2013.01); *C22C 38/40* (2013.01); *C22C 38/42* (2013.01); *C22C 38/44* (2013.01); *C22C 38/46* (2013.01); *C22C 38/58* (2013.01); *C21D 2211/004* (2013.01)

(58) Field of Classification Search

CPC ..... C22C 38/60; C21D 1/18
USPC ..... 148/334
See application file for complete search history.

(56) References Cited

U.S. PATENT DOCUMENTS

| | | | |
|---|---|---|---|
| 6,478,898 | B1 | 11/2002 | Sera et al. |
| 2015/0114525 | A1 | 4/2015 | Valls Anglés |

FOREIGN PATENT DOCUMENTS

| | | | | |
|---|---|---|---|---|
| CN | 103233170 | A | | 8/2013 |
| EP | 1 087 030 | A2 | | 3/2001 |
| EP | 2 662 460 | A1 | | 11/2013 |
| JP | H07-102342 | A | | 4/1995 |
| JP | 2004-204312 | A | | 7/2004 |
| JP | 2008-056982 | A | | 3/2008 |
| JP | 2008056982 | A | * | 3/2008 |
| JP | 2009-013465 | A | | 1/2009 |

OTHER PUBLICATIONS

European Communication pursuant to Article 94(3) EPC dated Jan. 25, 2018 in European Application No. 16 185 067.2.
Extended European Search Report in Application No. 16185087.2-1373 dated Nov. 24, 2016.
Taiwanese Office Acticn, dated Jan. 23, 2019, in Taiwanese Application No. 105125426 and English Translation thereof.
Chinese Office Action, dated May 13, 2019, in Japanese Application No. 201610729567.1 and English Translation thereof.
Taiwanese Office Action, dated Jun. 19, 2019, in Taiwanese Patent Application No. 105125426 and English Translation thereof.
Chinese Office Action, dated Jan. 23, 2020, in Chinese Patent Application No. 201610729567.1 and English Translation thereof.
Chinese Office Action, dated Jul. 13, 2020, in Chinese Patent Application No. 201610729567.1 and English Translation thereof.

* cited by examiner

*Primary Examiner* — Weiping Zhu
(74) *Attorney, Agent, or Firm* — McGinn I.P. Law Group, PLLC.

(57) ABSTRACT

The present invention relates to a steel and a mold constituted of the steel, in which the steel contains as essential elements, in terms of % by mass, 0.58%≤C≤0.70%, 0.010%≤Si≤0.30%, 0.50%≤Mn≤2.00%, 0.50%≤Cr<2.0%, 1.8%≤Mo≤3.0%, and 0.050%<V≤0.80%, with the balance being Fe and unavoidable impurities.

19 Claims, No Drawings

STEEL FOR MOLD AND MOLD

TECHNICAL FIELD

The present invention relates to a steel for mold and a mold. More particularly, the invention relates to a steel for use in constituting molds including molds for hot stamping, and also relates to such a mold.

BACKGROUND ART

Steel that constitutes molds for press-molding steel materials by hot stamping or the like are required to have a high thermal conductivity. So long as a steel for mold has a high thermal conductivity, the mold can deprive the steel material of the heat at a high rate to heighten the hardenability. In addition, the mold can be efficiently cooled during the period from the completion of the working of one steel material to the introduction of the next steel material, and the working cycle time can hence be shortened to improve the production efficiency.

For example, Patent Document 1 discloses a tool steel which is an inexpensive steel having a low rare-element content and which, despite this, can be used for constituting molds having high resistance to softening and a high thermal conductivity. This tool steel contains, in terms of % by mass, from 0.15 to 0.55% C, from 0.01 to 0.5% Si, from 0.01 to 2.0% Mn, from 0.3 to 1.5% Cr, from 0.8 to 2.0% Mo, from 0.05 to 0.5% V+W, from 0.01 to 2.0% Cu, and from 0.01 to 2.0% Ni, with the balance being Fe and unavoidable impurities.

Patent Document 1: JP-A-2009-13465

SUMMARY OF THE INVENTION

It is preferable that steels that constitute molds for molding steel materials should have not only a high thermal conductivity but also a high hardness. This is because a high hardness can enhance the wear resistance of the molds. However, in the case where the content of additive alloying elements such as Mo is low, it is difficult to obtain a steel for mold having an elevated hardness. For example, the alloy composition shown in Patent Document 1 makes it difficult to impart a high hardness in addition to a high thermal conductivity. In particular, in hot stamping to be used, for example, for press-molding steel sheets constituted of an ultrahigh-tensile-strength steel (ultrahigh-tensile steel), the steel that constitute the molds are required to possess a high thermal conductivity and a high hardness both on a high level.

The present invention addresses the problem of providing a steel for mold which can achieve both a high thermal conductivity and a high hardness, and a mold constituted of such steel.

In order to solve the problem, the present invention provides a steel for mold, consisting of, in terms of % by mass:

0.58%≤C≤0.70%,
0.010%≤Si≤0.30%,
0.50%≤Mn≤2.00%,
0.50%≤Cr<2.0%,
1.8%≤Mo≤3.0%, and
0.050%<V≤0.80%, and
optionally,
Al≤1.5%,
N≤0.20%,
Ti≤0.50%, Nb≤0.50%,
Zr≤0.50%,
Ta≤0.50%,
Co≤1.0%,
W≤5.0%,
Ni≤1.0%,
Cu≤1.0%,
S≤0.15%,
Ca≤0.15%,
Se≤0.35%,
Te≤0.35%,
Bi≤0.50%, and
Pb≤0.50%,
with the balance being Fe and unavoidable impurities.

The steel may contain at least one element selected from the group consisting of, in terms of % by mass, 0.0050%≤Al≤1.5%, 0.00030%≤N≤0.20%, 0.010%≤Ti≤0.50%, 0.010%≤Nb≤0.50%, 0.010%≤Zr≤0.50%, and 0.010%≤Ta≤0.50%.

The steel may contain at least one element selected from the group consisting of, in terms of % by mass, 0.10%≤Co≤1.0% and 0.10%≤W≤5.0%.

The steel may contain at least one element selected from the group consisting of, in terms of % by mass, 0.30%≤Ni<1.0% and 0.30%≤Cu≤1.0%.

The steel may contain at least one element selected from the group consisting of, in terms of % by mass, 0.010%≤S≤0.15%, 0.0010%≤Ca≤0.15%, 0.030%≤Se≤0.35%, 0.010%≤Te≤0.35%, 0.010%≤Bi≤0.50%, and 0.030%≤Pb≤0.50%.

It is preferable that the steel, after having been hardened and subsequently tempered at 500° C. or higher, should have a room-temperature hardness of 55 HRC or higher and a room-temperature thermal conductivity of 30 W/m/K or higher.

It is preferable that the steel, after having undergone hardening in which the steel is soaked at 1,030±20° C. and then cooled at a rate of from 5.0 to 9.0 ° C./min and further undergone tempering at 500° C. or higher, should have a room-temperature Charpy impact value of 20 J/cm$^2$ or higher.

The present invention further provides a mold constituted of the steel described above.

It is preferable that the mold should be a mold for hot stamping.

It is preferable that the mold should have a room-temperature hardness of 55 HRC or higher.

The steel for mold according to the present invention can achieve both a high thermal conductivity and a high hardness since this steel has the composition described above and, in particular, due to the balance between carbon content and the content of additive allying elements.

In the case where the steel for mold contains at least one element selected from Al, N, Ti, Nb, Zr, and Ta, the amounts of which are as specified above, a precipitate which serves as pinning grains during hardening is yielded. Consequently, the steel comes to have a structure made up of finer grains, resulting in a further improvement in toughness.

In the case where the steel for mold contains at least one element selected from Co and W, the amounts of which are as specified above, this steel can be made to have, in particular, more enhanced high-temperature strength.

In the case where the steel for mold contains at least one element selected from Ni and Cu, the amounts of which are as specified above, this steel has more improved hardenability.

In the case where the steel for mold contains at least one element selected from S, Ca, Se, Te, Bi, and Pb, the amounts of which are as specified above, this steel can be made to have more improved machinability.

In the case where the steel for mold, after having been hardened and subsequently tempered at 500° C. or higher, has a room-temperature hardness of 55 HRC or higher and a room-temperature thermal conductivity of 30 W/m/K or higher, it is easy to provide the required high hardness and high thermal conductivity when this steel is used to constitute molds for hot stamping or the like.

In the case where the steel for mold, after having undergone hardening in which the steel is soaked at 1,030±20° C. and then cooled at a rate of from 5.0 to 9.0 ° C./min and further undergone tempering at 500° C. or higher, has a room-temperature Charpy impact value of 20 J/cm$^2$ or higher, this steel has further enhanced toughness and molds produced therefrom are apt to be prevented from being damaged.

Since the mold according to the present invention is constituted of the steel for mold described above, this mold has both a high thermal conductivity and a high hardness. As a result, not only the efficiency of cooling the steel material being worked and of cooling the mold itself is excellent but also this mold has excellent wear resistance.

In the case where the mold is a mold for hot stamping, even a steel material having high tensile strength can be efficiently molded and hardened therewith since this mold has a high thermal conductivity and a high hardness. In addition, a high production efficiency is achieved.

In the case where the mold has a room-temperature hardness of 55 HRC or higher, especially high wear resistance can be obtained.

MODES FOR CARRYING OUT THE INVENTION

The steel for mold and mold of the present invention are explained below in detail.

The steel for mold of the present invention contains the following elements, and the remainder includes Fe and unavoidable impurities. The kinds of additive elements, proportions of the components, reasons for limitation, and the like are as described below. Incidentally, the unit of the component proportions is % by mass.

0.58%≤C≤0.70%

C forms a solid solution in the matrix phase during hardening to form a martensitic structure, thereby improving the hardness of steel. In addition, C forms carbides with Cr, Mo, V or the like to thereby improve the hardness of the steel.

By regulating the content of C to 0.58%≤C, a high hardness is acquired through a heat treatment. Although molds are required to have a hardness of about 55 HRC or higher at room temperature (25° C.) from the standpoint of achieving sufficient wear resistance, the C content regulated to 0.58%≤C makes it easy to attain a high hardness of 55 HRC or above. Preferably, 0.60%≤C.

Meanwhile, in case where the content of C is too high, coarse carbides are prone to be formed in a larger amount. In addition, γ crystal grains also are prone to be formed in an increased amount. As a result, it rather becomes impossible to obtain a high hardness. From the standpoint of ensuring a high hardness of 55 HRC or above through a heat treatment, the C content is regulated to C≤0.70%. Preferably, C≤0.65%.

0.010%≤Si≤0.30%

Si is effective as a deoxidizer and further has the effect of improving machinability during mold production. From the standpoint of obtaining these effects, the content of Si is regulated to 0.010%≤Si. Preferably, 0.050%≤Si.

Meanwhile, in case where the content of Si is too high, the steel has a reduced thermal conductivity. Consequently, from the standpoint of ensuring a high thermal conductivity, the content of Si is regulated to Si≤0.30%. Preferably, Si≤0.15%.

0.50%≤Mn≤2.00%

Mn has the effect of enhancing the hardenability of steel. Mn further has the effect of heightening the toughness (impact value) of the steel. From the standpoint of obtaining high hardenability and toughness, the content of Mn is regulated to 0.50%≤Mn. Preferably, 1.00%≤Mn.

Meanwhile, Mn is an element which lowers the thermal conductivity of steel. Consequently, from the standpoint of ensuring the thermal conductivity required of steels for mold (e.g., 30 W/m/K or higher at room temperature (25° C.)), the content of Mn is regulated to Mn≤2.00%. Preferably, Mn≤1.70%.

0.50%≤Cr<2.0%

Like Mn, Cr has the effect of enhancing the hardenability and toughness (impact value) of steel. From the standpoint of obtaining high hardenability and toughness, the content of Cr is regulated to 0.50%≤Cr. Preferably, 1.0%≤Cr.

Meanwhile, Cr also lowers the thermal conductivity of steel, like Mn. Consequently, from the standpoint of ensuring the thermal conductivity required of steels for mold (e.g., 30 W/m/K or higher at room temperature (25° C.)), the content of Cr is regulated to Cr<2.0%. Preferably, Cr≤1.6%.

1.8%≤Mo≤3.0%

Mo forms a secondary-precipitation carbide and thereby contributes to hardness enhancement. Furthermore, Mo has the effect of improving hardenability. From the standpoint of ensuring both the high hardness required of steels for mold, such as 55 HRC or higher, and hardenability, the content of Mo is regulated to 1.8%≤Mo. Preferably, 2.0%≤Mo.

Meanwhile, in case where the content of Mo is too high, a coarse Mo carbide precipitates in a large amount, making it rather impossible to obtain a high hardness. Furthermore, since the amount of the C present in a solid solution state decreases, this steel has a reduced hardness. In addition, since Mo is an expensive metal, an increase in material cost results. From the standpoints of ensuring both the high hardness required of steels for mold, such as 55 HRC or higher, and hardenability and of keeping the production cost low, the content of Mo is regulated to Mo≤3.0%. Preferably, Mo≤2.5%.

0.050%<V≤0.80%

V yields pinning grains which inhibit crystal grains from enlarging during hardening. As a result of the inhibition of the enlargement of crystal grains, the toughness (impact value) is improved. By regulating the content of V to 0.050%<V, crystal grain enlargement during hardening is effectively inhibited, resulting in enhanced toughness. Preferably, 0.30%≤V.

Meanwhile, in case where the content of V is too high, a coarse carbide precipitates in a large amount. As a result, such coarse carbide serves as starting points for cracks, resulting in a decrease, rather than an increase, in the toughness (impact value) of the steel. Consequently, from the standpoint of ensuring toughness, the content of V is regulated to V≤0.80%. Preferably, V≤0.70%.

The steel for mold according to the present invention contains C, Si, Mn, Cr, Mo, and V in the given amounts, and the remainder includes Fe and unavoidable impurities. The unavoidable impurities are thought to be, for example, the following elements: Al<0.0050%, N<0.00030%, P<0.050%, S<0.010%, Cu<0.30%, Ni<0.30%, W<0.10%, O<0.010%, Co<0.10%, Nb<0.010%, Ta<0.010%, Ti<0.010%, Zr<0.010%, B<0.0010%, Ca<0.0010%, Se<0.030%, Te<0.010%, Bi<0.010%, Pb<0.030%, Mg<0.020%, and REM (rare earth metal)<0.10%.

The steel for mold according to the present invention may optionally contain one or more elements selected from the following elements, besides the essential elements described above. The proportion of each element, reason for the limitation and the like are as follows.

Al≤1.5% (preferably, 0.0050%≤Al≤1.5%), N≤0.20% (preferably, 0.00030%≤N≤0.20%), Ti≤0.50% (preferably, 0.010%≤Ti≤0.50%), Nb≤0.50% (preferably, 0.010%≤Nb≤0.50%), Zr≤0.50% (preferably, 0.010%≤Zr≤0.50%), Ta≤0.50% (preferably, 0.010%—Ta≤0.50%)

Al, N, Ti, Nb, Zr, and Ta yield precipitates which function as pinning grains to inhibit crystal grains from enlarging during hardening. Since the crystal grains are inhibited from enlarging during hardening, the toughness (impact value) of steel is improved. The lower limit of the preferred content of each element has been specified as a content at which a precipitate is obtained in an amount necessary for producing the pinning effect. The upper limit thereof has been specified from the standpoint of inhibiting the precipitate from aggregating and thus coming not to effectively function as pinning grains.

Co≤1.0% (preferably, 0.10%≤Co≤1.0%), W≤5.0% (preferably, 0.10%≤W≤5.0%)

Co and W have the effect of improving the strength, in particular, high-temperature strength, of steel. The lower limit of the preferred content of each element has been specified as a content which is effective in strength improvement, while the upper limit thereof has been specified from the standpoints of inhibiting the thermal conductivity from decreasing and of reducing the production cost.

Ni<1.0% (preferably, 0.30%≤Ni<1.0%), Cu≤1.0% (preferably, 0.30%≤Cu≤1.0%)

Ni and Cu both have the effect of enabling austenite to be stably yielded in steel and retarding the formation of pearlite, thereby improving the hardenability. The lower limit of the preferred content of each element has been specified as a content at which the effect of improving hardenability is obtained, while the upper limit thereof has been specified from the standpoints of inhibiting the thermal conductivity from decreasing and of reducing the production cost. Furthermore, with respect to Ni, in case where Ni is incorporated in an amount exceeding the upper limit, this leads to an increase in the content of retained austenite, making it difficult to obtain a high hardness.

S≤0.15% (preferably, 0.010%≤S≤0.15%), Ca≤0.15% (preferably, 0.0010%≤Ca≤0.15%), Se≤0.35% (preferably, 0.030%≤Se≤0.35%), Te≤0.35% (preferably, 0.010%≤Te≤0.35%), Bi≤0.50% (preferably, 0.010%≤Bi≤0.50%), Pb≤0.50% (preferably, 0.030%≤Pb≤0.50%)

S, Ca, Se, Te, Bi, and Pb each have the effect of improving the machinability of steel. The lower limit of the preferred content of each element has been specified as a content at which the effect of improving machinability is obtained. Meanwhile, in case where each of those elements is added in excess, inclusions are yielded in a large amount and these inclusions serve as starting points for cracks, leading to a decrease in toughness (impact value). Consequently, the upper limit of the content thereof has been specified from the standpoint of avoiding such a problem.

Since the steel for mold according to the present invention contains the essential elements described above and optionally further contains additive elements described above, the steel becomes, through a heat treatment, a material that achieves both a high hardness and a high thermal conductivity. It is desirable that steels for mold, in particular, steel materials that constitute molds for hot stamping, should have a high hardness of 55 HRC or higher at room temperature (25° C.) and a thermal conductivity as high as 30 W/m/K or above at room temperature (25° C.). The steel for mold according to the present invention can attain such a high hardness and such a high thermal conductivity. It is preferable that this steel, in the state of having undergone hardening and tempering performed at 500° C. or higher, should have a room-temperature hardness of 55 HRC or higher and a room-temperature thermal conductivity of 30 W/m/K or higher.

In the steel for mold according to the present invention, both a high hardness and a high thermal conductivity have been attained especially due to the effect of a balance between the content of C and the content of additive alloying elements. In the case where the content of alloying elements including Si, Mn, and Cr is increased, the hardness can be heightened but the thermal conductivity decreases. By regulating the content of additive metal elements including those elements to the values described above, both a high hardness and a high thermal conductivity are attained. In addition, since the content of expensive additive elements is low, the cost of producing the steel can be inhibited form increasing.

Hot stamping (also called hot pressing) is a technique in which a steel sheet is heated to a temperature in the austenitic-transformation range and is then shaped and simultaneously hardened in a mold to enhance the strength thereof. When hot stamping is used, it is easy to work even an ultrahigh-tensile-strength steel (ultrahigh-tensile steel) or the like which cannot show sufficient moldability in cold working. In the case where the mold used in hot stamping has a low thermal conductivity, the rate at which the heat of the heated steel sheet is removed by the mold is low and the hardening of the steel sheet necessitates a prolonged time period. In addition, after the steel sheet is molded and taken out of the mold, much time is required for this mold to cool down sufficiently before the next steel sheet is introduced thereinto. Thus, the working cycle time is prolonged, resulting in a decrease in production efficiency. In case where the next steel sheet is worked in the mold which has not cooled down sufficiently, the temperature of this steel sheet cannot be sufficiently lowered, resulting in reduced hardenability. However, so long as a mold having a thermal conductivity of about 30 W/m/K or higher at room temperature (25° C.) is used, hardening can be efficiently conducted and the working cycle time can be shortened, thereby enabling the hot stamping to be carried out with a high production efficiency.

In case where molds including molds for hot stamping have a low hardness, the molds are prone to wear and suffer damage during the molding. So long as a mold having a hardness of about 55 HRC or higher is used, high wear resistance can be attained even in hot stamping for molding an ultrahigh-tensile-strength steel.

It is preferable that this steel should have high toughness, that is, a high impact value, besides a high hardness and a high thermal conductivity. The higher the toughness, the more the mold can be inhibited from suffering damage such as cracking. For example, it is desirable that steel for mold, after having undergone hardening in which the steel is soaked at 1,030±20° C. and then cooled at a rate of from 5.0 to 9.0° C./min and further undergone tempering at 500° C. or higher, should have a room-temperature Charpy impact value of 20 J/cm$^2$ or higher. An appropriate time period of the soaking at that temperature is, for example, 45±15 minutes. The Charpy impact value may be evaluated through a Charpy impact test using JIS No. 3 impact specimens (with a 2-mm U-notch).

The steel for mold according to the present invention can be made to have improved properties in terms of toughness (impact value), high-temperature strength, high hardenability, and machinability, besides a high hardness and a high thermal conductivity, by adding various optional-component elements in addition to the essential-component elements. In particular, since this steel has high hardenability, high strength and high toughness can be attained even when large molds are produced therefrom. Consequently, molds to be produced therefrom are less apt to be limited in size.

As described above, the steel for mold according to the present invention has a high hardness and a high thermal conductivity and can hence be suitable for constituting molds for use in steel-material press working including hot stamping. However, applications of the steel are not limited thereto, and the steel can be used for constituting molds for various applications, for example, for molding resin or rubber materials.

EXAMPLES

The present invention will be explained below in more detail by reference to Examples.

Steels for mold, each having the composition (unit: % by mass) shown in Table 1 were produced. Specifically, steels respectively having the compositions were each produced as a melt in a vacuum induction furnace and then cast to produce an ingot. The ingots obtained were hot-forged and thereafter subjected to spheroidizing annealing and then to the following tests.

Specimens were cut out from an approximately central portion of each of the blocks respectively constituted of the steels thus obtained, and were subjected to tests for hardness measurement, determination of the thermal conductivity, measurement of Charpy impact value, crystal grain evaluation, measurement of high-temperature hardness, and machinability evaluation. The test methods are explained below.

Hardness Measurement

Specimens having a size of 50 mm (diameter)×15 mm were soaked at 1,030° C. for 45 minutes and then cooled to 50° C. at a rate of 30° C./min to conduct hardening. Thereafter, tempering was performed twice in which the specimens were soaked at from 500 to 600° C. for 1 hour and then air-cooled to 30° C. These specimens were cut, and the resultant cut surfaces were subjected to surface grinding and examined for hardness with a Rockwell C scale (HRC) at room temperature (25° C.). The maximum of the hardness values obtained among the temperature range during the tempering was recorded. The case where the maximum hardness was 55 HRC or higher was rated as good "A", while the case where the maximum hardness was less than 55 HRC was rated as poor "B".

Determination of Thermal Conductivity

From the specimen on which a maximum hardness had been obtained in the hardness measurement, a region having a size of 10 mm (diameter)×2 mm was cut out as a specimen for determining the thermal conductivity. This specimen was examined for the thermal conductivity λ (W/m/K) by the laser flash method. The case where the thermal conductivity was 30 W/m/K or higher was rated as good "A", while the case where the thermal conductivity was less than 30 W/m/K was rated as poor "B".

Measurement of Charpy Impact Value

In order to evaluate the toughness of each steel, the Charpy impact value was measured. From each steel having a size of 50 mm (diameter)×70 mm, specimens having a size of 10 mm×10 mm×55 mm were cut out in ½ R positions. These specimens were subjected to a heat treatment, in which the specimens were soaked at 1,030° C. for 45 minutes and then cooled to 50° C. at three rates of 5° C./min, 7° C./min, and 9° C./min, to conduct hardening. These specimens were subjected twice to a treatment in which the specimens were soaked for 1 hour at the tempering temperature which had resulted in a maximum hardness in the hardness measurement and were then air-cooled to 30° C. Thereafter, JIS No. 3 impact specimens (2-mm U-notch) were obtained therefrom, and a Charpy impact test was conducted in accordance with JIS Z 2242: 2015 to measure a minimum impact value. The case where the Charpy impact value was 20 J/cm$^2$ or higher with respect to all the specimens which had been cooled at the rates of from 5 to 9° C./min during the hardening was rated as good "A", while the case where the Charpy impact value was less than 20 J/cm$^2$ even with respect to any one of the cooling rates was rated as poor "B". Incidentally, each minimum impact value in Table 2 indicates the measured value for that one of the three cooling rates which had resulted in a lowest impact value.

Crystal Grain Evaluation

Crystal grains were evaluated in order to assess whether hardening resulted in crystal grain enlargement or not. Specimens having a size of 50 mm (diameter)×15 mm were soaked at 1,050° C. for 5 hours and then cooled to 50° C. at a rate of 30° C./min to conduct hardening. These specimens were cut, and the resultant cut surfaces were ground and corroded. A region having an area of 450 mm$^2$ in each cut surface was examined with a microscope. The maximum grain diameter in the region was evaluated in terms of the grain size number defined in JIS G 0551: 2013. The case where the grain size number was 4 or larger was rated as good "A", while the case where the grain size number was less than 4 was rated as poor "B".

Measurement of High-temperature Hardness

A measurement of high-temperature hardness was made in order to evaluate high-temperature strength. Specimens having a size of 50 mm (diameter)×15 mm were soaked at 1,030° C. for 45 minutes and then cooled to 50° C. at a rate of 30° C./min to conduct hardening. Thereafter, tempering was performed twice in which the specimens were soaked for 1 hour at the temperature which had resulted in a maximum hardness in the hardness measurement, and were then air-cooled to 30° C. Thereafter, specimens for high-temperature hardness measurement which had a size of 10 mm (diameter)×5 mm were obtained therefrom. The specimens were cut and the resultant cut surfaces were ground. Thereafter, the specimens were heated with a heater and examined for Vickers hardness in accordance with JIS Z 2244: 2009. The case where the high-temperature hardness at 500° C. was 450 HV or higher was rated as good "A", while the case where the high-temperature hardness at 500° C. was less than 450 HV was rated as poor "B".

Machinability Evaluation

Specimens in an annealed state having a hardness of 24 HRC or less were subjected to end milling using an insert type cemented carbide tip (non-coated; 32 mm in diameter) under the following machining conditions. The distance over which the specimens were machined before the life of the cutting tool was reached was measured. The case where the machining distance was 9 m or longer but less than 15 m was rated as good "A", while the case where the machining distance was 15 m or longer was rated as especially good "S". The machining conditions included: machining speed, 150 m/min; feed rate, 0.15 mm/rev; cutting dimensions, 1 mm×4 mm; machining direction, downward cutting; cooling mode, air blowing. It was deemed that the tool life was reached when the maximum tool wear loss had exceeded 250 μm.

Results

In Table 1 are shown the compositions of the steels for mold according to the Examples and Comparative Examples. In Tables 2 and 3 are shown the results of the tests.

TABLE 1

| | | C | Si | Mn | Cr | Mo | V | Other elements |
|---|---|---|---|---|---|---|---|---|
| Example | 1 | 0.68 | 0.17 | 1.97 | 0.87 | 2.65 | 0.77 | — |
| | 2 | 0.62 | 0.14 | 0.91 | 0.51 | 2.89 | 0.37 | — |

TABLE 1-continued

| | | C | Si | Mn | Cr | Mo | V | Other elements |
|---|---|---|---|---|---|---|---|---|
| | 3 | 0.69 | 0.22 | 1.14 | 1.30 | 2.99 | 0.71 | — |
| | 4 | 0.60 | 0.11 | 1.62 | 1.02 | 2.01 | 0.63 | — |
| | 5 | 0.61 | 0.24 | 1.31 | 1.62 | 2.34 | 0.51 | — |
| | 6 | 0.62 | 0.29 | 0.53 | 1.77 | 2.44 | 0.12 | — |
| | 7 | 0.67 | 0.06 | 1.73 | 1.94 | 2.58 | 0.06 | — |
| | 8 | 0.66 | 0.18 | 0.81 | 1.13 | 2.08 | 0.22 | — |
| | 9 | 0.69 | 0.21 | 1.00 | 0.71 | 2.19 | 0.79 | — |
| | 10 | 0.65 | 0.27 | 0.68 | 1.43 | 2.76 | 0.33 | — |
| | 11 | 0.66 | 0.16 | 0.60 | 1.52 | 2.53 | 0.47 | Al, 1.47 |
| | 12 | 0.62 | 0.23 | 1.16 | 0.56 | 2.48 | 0.33 | N, 0.194 |
| | 13 | 0.67 | 0.16 | 1.79 | 1.73 | 2.02 | 0.47 | Ti, 0.48 |
| | 14 | 0.62 | 0.08 | 1.55 | 1.59 | 2.79 | 0.22 | Nb, 0.48 |
| | 15 | 0.67 | 0.19 | 1.23 | 1.28 | 2.28 | 0.55 | Zr, 0.50 |
| | 16 | 0.63 | 0.16 | 1.31 | 1.88 | 2.13 | 0.42 | Ta, 0.47 |
| | 17 | 0.67 | 0.14 | 1.12 | 0.61 | 2.65 | 0.26 | Co, 0.99 |
| | 18 | 0.63 | 0.03 | 0.94 | 1.46 | 2.57 | 0.58 | W, 4.97 |
| | 19 | 0.65 | 0.17 | 1.35 | 0.74 | 2.69 | 0.15 | Ni, 0.97 |
| | 20 | 0.69 | 0.10 | 1.43 | 0.85 | 2.26 | 0.58 | Cu, 0.99 |
| | 21 | 0.61 | 0.11 | 1.60 | 1.86 | 2.38 | 0.67 | S, 0.14 |
| | 22 | 0.66 | 0.07 | 1.70 | 1.43 | 2.05 | 0.37 | Ca, 0.13 |
| | 23 | 0.68 | 0.11 | 0.55 | 1.94 | 2.18 | 0.60 | Se, 0.34 |
| | 24 | 0.65 | 0.11 | 0.71 | 0.55 | 2.69 | 0.74 | Te, 0.35 |
| | 25 | 0.63 | 0.28 | 1.02 | 1.19 | 2.50 | 0.37 | Bi, 0.48 |
| | 26 | 0.69 | 0.21 | 0.85 | 1.02 | 2.59 | 0.52 | Pb, 0.47 |
| | 27 | 0.59 | 0.10 | 1.25 | 1.92 | 1.83 | 0.52 | Nb, 0.44; W, 4.75; S, 0.11 |
| Comp. Example | 1 | 0.53 | 0.07 | 0.89 | 1.64 | 2.24 | 0.63 | — |
| | 2 | 0.89 | 0.26 | 0.60 | 0.98 | 2.86 | 0.15 | — |
| | 3 | 0.65 | 0.54 | 0.93 | 0.95 | 2.02 | 0.43 | — |
| | 4 | 0.68 | 0.12 | 0.42 | 0.95 | 2.64 | 0.72 | — |
| | 5 | 0.62 | 0.28 | 2.49 | 0.55 | 2.78 | 0.23 | — |
| | 6 | 0.61 | 0.19 | 1.33 | 0.43 | 2.16 | 0.58 | — |
| | 7 | 0.68 | 0.06 | 1.84 | 2.66 | 2.39 | 0.50 | — |
| | 8 | 0.64 | 0.23 | 1.73 | 1.37 | 1.68 | 0.41 | — |
| | 9 | 0.63 | 0.24 | 1.00 | 1.83 | 3.47 | 0.32 | — |
| | 10 | 0.66 | 0.15 | 1.63 | 1.83 | 2.92 | 0.01 | — |
| | 11 | 0.65 | 0.22 | 0.74 | 0.76 | 2.69 | 1.05 | — |

TABLE 2

| | | Hardness | | Coefficient of thermal conductivity | | Charpy impact value | | Crystal grains | | High-temperature hardness | | Machinability | |
|---|---|---|---|---|---|---|---|---|---|---|---|---|---|
| | | Maximum hardness (HRC) | Rating | Coefficient of thermal conductivity (W/m/K) | Rating | Minimum impact value (J/cm$^2$) | Rating | Crystal grain size | Rating | 500° C. hardness (HV) | Rating | Machining distance (m) | Rating |
| Example | 1 | 56.9 | A | 31.6 | A | 30.4 | A | 7.5 | A | 485 | A | 9.2 | A |
| | 2 | 57.4 | A | 35.0 | A | 22.5 | A | 6.3 | A | 467 | A | 9.0 | A |
| | 3 | 57.8 | A | 32.1 | A | 29.8 | A | 7.4 | A | 509 | A | 9.7 | A |
| | 4 | 55.2 | A | 32.5 | A | 25.5 | A | 6.9 | A | 465 | A | 9.9 | A |
| | 5 | 56.0 | A | 30.8 | A | 28.0 | A | 6.6 | A | 491 | A | 9.1 | A |
| | 6 | 56.3 | A | 31.8 | A | 23.4 | A | 5.6 | A | 486 | A | 9.1 | A |
| | 7 | 56.7 | A | 30.6 | A | 30.9 | A | 5.6 | A | 496 | A | 9.3 | A |
| | 8 | 55.5 | A | 33.5 | A | 20.3 | A | 6.0 | A | 455 | A | 9.8 | A |
| | 9 | 55.9 | A | 33.8 | A | 22.6 | A | 7.6 | A | 464 | A | 9.3 | A |
| | 10 | 57.1 | A | 32.3 | A | 25.1 | A | 6.2 | A | 493 | A | 9.5 | A |
| | 11 | 56.6 | A | 33.3 | A | 24.7 | A | 8.5 | A | 493 | A | 9.9 | A |
| | 12 | 56.4 | A | 33.6 | A | 21.8 | A | 8.7 | A | 455 | A | 9.2 | A |
| | 13 | 55.4 | A | 30.2 | A | 29.2 | A | 7.9 | A | 482 | A | 9.7 | A |
| | 14 | 57.1 | A | 31.7 | A | 29.9 | A | 8.1 | A | 496 | A | 9.2 | A |
| | 15 | 56.0 | A | 32.2 | A | 25.8 | A | 8.1 | A | 479 | A | 9.5 | A |
| | 16 | 55.6 | A | 30.9 | A | 27.8 | A | 7.6 | A | 490 | A | 9.0 | A |
| | 17 | 56.9 | A | 34.3 | A | 32.3 | A | 6.1 | A | 511 | A | 9.2 | A |
| | 18 | 56.6 | A | 33.7 | A | 31.8 | A | 6.8 | A | 559 | A | 9.6 | A |
| | 19 | 57.0 | A | 33.2 | A | 33.8 | A | 5.8 | A | 461 | A | 9.4 | A |
| | 20 | 56.0 | A | 33.4 | A | 34.7 | A | 7.0 | A | 464 | A | 9.4 | A |

TABLE 3

| | | Hardness | | Coefficient of thermal conductivity | | Charpy impact value | | Crystal grains | | High-temperature hardness | | Machinability | |
|---|---|---|---|---|---|---|---|---|---|---|---|---|---|
| | | Maximum hardness (HRC) | Rating | Coefficient of thermal conductivity (W/m/K) | Rating | Minimum impact value (J/cm$^2$) | Rating | Crystal grain size | Rating | 500° C. hardness (HV) | Rating | Machining distance (m) | Rating |
| Example | 21 | 56.1 | A | 30.7 | A | 31.6 | A | 7.0 | A | 506 | A | 16.4 | S |
| | 22 | 55.5 | A | 31.8 | A | 26.9 | A | 6.4 | A | 470 | A | 16.5 | S |
| | 23 | 55.8 | A | 32.9 | A | 25.5 | A | 7.0 | A | 500 | A | 17.0 | S |
| | 24 | 57.0 | A | 35.6 | A | 22.6 | A | 7.3 | A | 474 | A | 16.1 | S |
| | 25 | 56.4 | A | 32.1 | A | 24.5 | A | 6.3 | A | 477 | A | 17.4 | S |
| | 26 | 56.8 | A | 33.4 | A | 24.0 | A | 6.9 | A | 479 | A | 17.9 | S |
| | 27 | 55.8 | A | 31.4 | A | 31.1 | A | 8.0 | A | 549 | A | 16.4 | S |
| Comp. Example | 1 | 49.6 | B | 33.1 | A | 26.1 | A | 6.7 | A | 412 | B | 9.8 | A |
| | 2 | 51.1 | B | 33.7 | A | 22.0 | A | 6.4 | A | 425 | B | 9.1 | A |
| | 3 | 55.3 | A | 25.7 | B | 20.7 | A | 6.5 | A | 454 | A | 9.7 | A |
| | 4 | 56.9 | A | 35.3 | A | 13.8 | B | 7.4 | A | 486 | A | 9.7 | A |
| | 5 | 57.1 | A | 28.3 | B | 29.4 | A | 5.9 | A | 460 | A | 9.3 | A |
| | 6 | 55.6 | A | 33.8 | A | 11.6 | B | 6.8 | A | 409 | B | 9.2 | A |
| | 7 | 56.3 | A | 25.8 | B | 36.0 | A | 6.8 | A | 528 | A | 9.2 | A |
| | 8 | 50.5 | B | 30.5 | A | 25.6 | A | 6.4 | A | 404 | B | 9.5 | A |
| | 9 | 50.8 | B | 31.0 | A | 32.2 | A | 6.2 | A | 530 | A | 9.4 | A |
| | 10 | 57.5 | A | 30.3 | A | 15.1 | B | 2.4 | B | 418 | B | 9.1 | A |
| | 11 | 57.0 | A | 34.1 | A | 12.3 | B | 1.2 | B | 492 | A | 9.8 | A |

In Comparative Example 1, the steel has reduced hardnesses (maximum hardness and 500° C. hardness) due to the too low content of C. Meanwhile, in Comparative Example 2, the content of C is too high. In this case also, the steel has reduced hardnesses (maximum hardness and 500° C. hardness). Namely, a sufficiently high hardness cannot be obtained in cases where the content of C is either too high or too low.

In Comparative Example 3, the steel has a reduced thermal conductivity due to the too high content of Si.

In Comparative Example 4, the steel has a reduced Charpy impact value due to the too low content of Mn. Meanwhile, in Comparative Example 5, the steel has a reduced thermal conductivity due to the too high content of Mn.

In Comparative Example 6, the steel has a reduced Charpy impact value due to the too low content of Cr. In addition, this steel has a reduced high-temperature hardness. This is because the amount of carbides is small and, hence, a sufficient high-temperature strength cannot be obtained. Meanwhile, in Comparative Example 7, the steel has a reduced thermal conductivity due to the too high content of Cr.

In Comparative Example 8, the steel has reduced hardnesses (maximum hardness and 500° C. hardness) due to the too low content of Mo. Meanwhile, the steel has a reduced hardness also in the case where the content of Mo is too high, as in Comparative Example 9. Namely, a sufficiently high hardness cannot be obtained in cases where the content of Mo is either too high or too low.

In Comparative Example 10, the steel contains coarse crystal grains due to the too low content of V. Furthermore, the enlargement of crystal grains has resulted in decreases in Charpy impact value and high-temperature hardness. Meanwhile, in Comparative Example 11, the content of V is too high and, in this case also, a coarse carbide has precipitated in a large amount, resulting in a decrease in Charpy impact value.

In contrast to the steels for mold according to the Comparative Examples, the steels for mold according to the Examples of the present invention each have a hardness as high as 55 HRC or above and a thermal conductivity as high as 30 W/m/K or more. In addition, satisfactory ratings were obtained with respect to all of Charpy impact value, crystal grains, high-temperature hardness, and machinability. With respect to machinability, especially satisfactory results were obtained in Examples 21 to 27, in which the steels contained S, Ca, Se, Te, Bi, and Pb.

Embodiments and Examples of the present invention have been explained above. The present invention should not be construed as being limited to the embodiments and Examples, and can be variously modified.

The present application is based on Japanese Patent Application No. 2015-168946 filed on Aug. 28, 2015, which contents are incorporated herein by reference.

What is claimed is:

1. A steel consisting of, in terms of % by mass:

0.58%≤C≤0.70%;

0.010%≤Si≤0.30%;

0.50%≤Mn≤2.00%;

0.50%≤Cr<2.0%;

1.8%≤Mo≤3.0%; and 0.050%<V≤0.80%; and optionally,

Al≤1.5%;

N≤0.20%;

Ti≤0.50%;

Nb≤0.50%;

Zr≤0.50%;

Ta≤0.50%;

Co≤1.0%;

W≤5.0%;

Ni<1.0%;

Cu≤1.0%;

S≤0.15%;

Ca≤0.15%;

Se≤0.35%;
Te≤0.35%;
Bi≤0.50%; and
Pb≤0.50%;
with the balance being Fe and unavoidable impurities,
wherein the steel has a room-temperature hardness of 55 HRC or higher after having been hardened and subsequently tempered at 500° C. or higher,
wherein the steel has a grain size number of 5.6 or higher after having been hardened, and
wherein the steel has a room-temperature Charpy impact value of 20 J/cm$^2$ or higher, after having undergone hardening in which the steel is soaked at 1,030° C. ±20° C. and then cooled at a rate of from 5.0° C./min to 9.0° C./min and further underdone tempering at 500° C. or higher.

2. The steel according to claim 1, comprising, in terms of % by mass, at least one element selected from the group consisting of 0.0050%≤Al≤1.5%, 0.00030%≤N≤0.20%, 0.010%≤Ti≤0.50%, 0.010%≤Nb≤0.50%, 0.010%≤Zr≤0.50%, and 0.010%≤Ta≤0.50%.

3. The steel according to claim 1, comprising, in terms of % by mass, at least one element selected from the group consisting of 0.10%≤Co≤1.0% and 0.10%≤W≤5.0%.

4. The steel according to claim 1, comprising, in terms of % by mass, at least one element selected from the group consisting of 0.30%≤Ni≤1.0% and 0.30%≤Cu≤1.0%.

5. The steel according to claim 1, comprising, in terms of % by mass, at least one element selected from the group consisting of 0.010%≤S≤0.15%, 0.0010%≤Ca≤0.15%, 0.030%≤Se≤0.35%, 0.010%≤Te≤0.35%, 0.010%≤Bi≤0.50%, and 0.030%≤Pb≤0.50%.

6. The steel according to claim 1, having a room-temperature thermal conductivity of 30 W/m/K or higher, after having been hardened and subsequently tempered at 500° C. or higher.

7. A mold constituted of the steel described in claim 1.

8. The mold according to claim 7, being a mold for hot stamping.

9. The steel according to claim 1, wherein 0.61%≤C≤0.69%.

10. The steel according to claim 1, wherein 2.01%≤Mo≤2.99%.

11. The steel according to claim 1, wherein 0.30%<V≤0.70%.

12. The steel according to claim 1, wherein the room-temperature hardness is more than 55 HRC.

13. The steel according to claim 1, wherein 0.62%≤C≤0.69%.

14. The steel according to claim 1, wherein 2.34%≤Mo≤2.99%.

15. A steel consisting of, in terms of % by mass:
0.58%≤C≤0.70%;
0.010%≤Si≤0.30%;
0.50%≤Mn≤2.00%;
0.50%≤Cr≤1.77%;
1.8%≤Mo≤3.0%; and
0.050%≤V≤0.80%,
with a balance being Fe and unavoidable impurities,
wherein the steel has a room-temperature hardness of 55 HRC or higher after having been hardened and subsequently tempered at 500° C. or higher,
wherein the steel has a grain size number of 5.6 or higher after having been hardened, and
wherein the steel has a room-temperature Charpy impact value of 20 J/cm$^2$ or higher, after having undergone hardening in which the steel is soaked at 1,030° C.±20° C. and then cooled at a rate of from 5.0° C./min to 9.0° C./min and further undergone tempering at 500° C. or higher.

16. The steel according to claim 15, wherein 0.61%≤C≤0.69%.

17. The steel according to claim 15, wherein 2.01%≤Mo≤2.99%.

18. A steel comprising, in terms of % by mass:
0.58%≤C≤0.70%;
0.010%≤Si≤0.30%;
0.50%≤Mn≤2.00%;
0.50%≤Cr≤1.77%;
1.8%≤Mo≤3.0%;
0.050%<V≤0.80%; and
at least one element selected from the group consisting of:
Al≤1.5%;
N≤0.20%;
Ti≤0.50%;
Nb≤0.50%;
Zr≤0.50%;
Ta≤0.50%;
Co≤1.0%;
W≤5.0%;
Ni<1.0%;
Cu≤1.0%;
S≤0.15%;
Ca≤0.15%;
Se≤0.35%;
Te≤0.35%;
Bi≤0.50%; and
Pb≤0.50%,
with a balance being Fe and unavoidable impurities,
wherein the steel has a room-temperature hardness of 55 HRC or higher after having been hardened and subsequently tempered at 500° C. or higher, and
wherein the steel has a grain size number of 5.6 or higher after having been hardened.

19. The steel according to claim 18, wherein at least one of Al, N, Nb, Ta, W, Cu, S, Ca, Se, Te, and Pb is included in the steel.

* * * * *